United States Patent [19]

Tinnes et al.

[11] Patent Number: 4,618,126

[45] Date of Patent: Oct. 21, 1986

[54] SWIVELLING SLIDING CLOSURE UNIT

[75] Inventors: Bernhard Tinnes, Zollikerberg; Bernhard Knell, Thalwil; Walter Vetterli, Winterthur, all of Switzerland

[73] Assignee: Metacon AG, Zurich, Switzerland

[21] Appl. No.: 748,043

[22] Filed: Jun. 24, 1985

[30] Foreign Application Priority Data

Jun. 22, 1984 [DE] Fed. Rep. of Germany ..... 3423156

[51] Int. Cl.[4] ..... B22D 41/08

[52] U.S. Cl. ..... 266/271; 266/287; 222/598; 222/600

[58] Field of Search ..... 266/236, 287, 275, 272, 266/45, 271; 222/600, 599, 598

[56] References Cited

U.S. PATENT DOCUMENTS

| | | | |
|---|---|---|---|
| 1,507,852 | 9/1924 | Pleukharp et al. | 222/598 |
| 3,565,299 | 2/1971 | Bieri | 222/598 |
| 4,500,018 | 2/1985 | Zaugg et al. | 222/598 |

FOREIGN PATENT DOCUMENTS

| | | | |
|---|---|---|---|
| 1281643 | 10/1968 | Fed. Rep. of Germany | 222/598 |
| 1928400 | 1/1974 | Fed. Rep. of Germany . | |
| 2404425 | 8/1974 | Fed. Rep. of Germany . | |
| 2840171 | 3/1980 | Fed. Rep. of Germany . | |

*Primary Examiner*—L. Dewayne Rutledge
*Assistant Examiner*—S. Kastler
*Attorney, Agent, or Firm*—Wenderoth, Lind & Ponack

[57] ABSTRACT

A swivelling sliding closure unit includes a stationary refractory plate having a discharge opening and supported by a stationary housing. A swivel pin is fixed to the stationary housing, and a swivel lever having first and second ends is mounted on the swivel pin by a gimbal bearing. A movable refractory plate has therethrough a discharge opening and is supported at the first end of the swivel lever by a movable housing to enable pivoting of the movable refractory plate with respect to the swivel lever. The swivel lever is rotated about the swivel pin to move the movable refractory plate between positions enabling and blocking discharge of molten metal from a metallurgical vessel and also to a replacement position. A rolling element is mounted on the stationary housing, and a raceway formed on the second end of the swivel lever abuts the rolling element. A bracket is hingedly connected to the stationary housing and is connectable to the swivel lever when the swivel lever is in the replacement position thereof. Thereby, upon removal of a clamp which clamps the swivel lever to the swivel pin, the swivel lever may be swung to an open position enabling replacement of the refractory plates.

11 Claims, 7 Drawing Figures

SWIVELLING SLIDING CLOSURE UNIT

BACKGROUND OF THE INVENTION

The present invention relates to a swivelling, sliding closure unit or sliding gate for controlling the discharge of molten metal from a metallurgical vessel. The invention more particularly relates to such a unit of the type including a movable frame or housing carrying a movable or sliding refractory plate and suspended by a universal joint axle on one arm of a dual arm swivel lever operated by a power transmitter or moving device and having as its swivel axis a ball joint which forms another universal joint axle and which is guided, while being resiliently supported on a second arm of the lever, by a raceway and rolling element.

This general type of swivelling, sliding closure unit is disclosed in West German Patent No. 19 28 400 wherein there is shown a movable housing arranged to move on a universal joint and which is capable of adapting the sliding surface of the movable plate to practically any position of the complementary sliding surface of the fixed or stationary bottom refractory plate. During operation of this type of unit, i.e., during relative movement of the complementary sliding surfaces of the two refractory plates, changes in position and deformations, for example, resulting from thermal stresses and high static pressures are compensated. As a result, a uniform compressive load always is exerted on the complementary sliding surfaces. This provides for a reliable seal, particularly since spring mechanisms which operate to press the movable plate toward the stationary plate and are subject to deterioration can be located at safe positions relatively far from the discharging stream of

SUMMARY OF THE INVENTION

With the above discussion in mind, it is an object of the present invention to provide such a swivelling, sliding closure unit, but whereby the efficiency and handling properties thereof are improved.

This object is achieved in accordance with the present invention by the provision of a swivelling, sliding closure unit including a stationary refractory plate having a discharge opening, a stationary housing adapted to be fixed to the bottom of a metallurgical vessel and supporting the stationary refractory plate in a position with the discharge opening thereof in alignment with an outlet opening of the metallurgical vessel, a swivel pin fixed to and extending downwardly from the stationary housing, a swivel lever having first and second ends, gimbal bearing means supporting the swivel lever at a portion thereof between the first and second ends to enable the swivel lever to universally rotate about the swivel pin, a movable refractory plate having therethrough a discharge opening, and means at the first end of the swivel lever for supporting the movable refractory plate in position against the stationary refractory plate and for enabling the movable refractory plate to pivot with respect to the swivel lever about a pivot axis. The swivel lever is pivoted about the swivel pin and thereby slides the movable refractory plate with respect to the stationary refractory plate between a first position whereat the discharge opening of the movable refractory plate is aligned with the discharge opening of the stationary refractory plate, a second position whereat the discharge openings are out of alignment, and a replacement third position. A rolling element is mounted on the stationary housing and a raceway is formed on the second end of the swivel lever and abuts the rolling element during rotation of the swivel lever about the swivel pin. Clamping means removable mounts the swivel lever on the swivel pin and urges the movable refractory plate toward the stationary refractory plate and urges the raceway toward the rolling element. The gimbal bearing means is in the form of a first annular member defining a partial spherical concave recess and mounted within the swivel lever spaced coaxially about the swivel pin, and a second annular member defining a complementary partial spherical convex surface and mounted on the clamping means. The clamping means has internal threads threaded onto external threads of the swivel pin, thereby urging the convex surface into complementary engagement with the concave recess and enabling universal swivelling movement of the swivel lever about the swivel pin. Bracket means is hingedly connected to the stationary housing and is connectable to the swivel lever when the swivel lever is in the replacement third position thereof, for, upon removal of the clamping means, swinging the swivel lever and the movable refractory plate away from the swivel pin and the stationary refractory plate to an open position enabling replacement of the two refractory plates.

In accordance with the above arrangement of the present invention, the gimbal bearing arrangement of the swivel lever on the swivel pin which is fixed to the stationary housing results in a reliable suspension of the swivel lever. The design of the swivel or gimbal bearing according to the present invention provides conditions enabling easy mounting and dismounting of the swivel lever with respect to the swivel pin, by means of the bracket after removal of the clamp. An important feature of the arrangement of the invention is that there are no moving parts on the swivel lever aside from the unit of the movable housing and movable refractory plate pivotally mounted on one end of the swivel lever. Furthermore, as a result of the arrangement of the rolling element being fixed at a position opposite the raceway which moves with the swivel lever, a very effective contact pressure function of the swivel lever is achieved, particularly when the axis of the rolling element is located on a straight line extending through or intersecting both the axis of the swivel pin and the center axis of the outlet opening of the metallurgical vessel, i.e., the discharge opening of the stationary refractory plate. Due to this arrangement, the sealing surface area of the removable refractory plate surrounding the discharge opening in the stationary refractory plate is very effectively and uniformly loaded in any position of the movable refractory plate or of the swivel lever. Advantageously, the contact pressure of the swivel lever is elastic, this being achieved by the swivel lever itself being spring loaded or preferably by the use of spring means urging the rolling element toward the raceway with a spring force increasing progressively in the area of the spring deflection end.

The novel combination of features of the present invention results in a swivelling, sliding closure unit which is very effective for applying contact pressure, yet which is tightly designed and which has a swivel lever with no moving guide elements which can be handled without difficulty, especially during maintenance for replacement operations of the refractory wear parts.

In accordance with a further feature of the present invention, the bracket means has a first end hinged to a longitudinal edge of the stationary housing by means of a first pin and a second end which may be connected to an end of the swivel lever by means of a second pin extending parallel to the first pin. Thus, the swivel lever can be removed with precision from the swivel pin to the replacement position and brought back accurately to its operating position.

With respect to the geometrical design of the elements of the unit of the present invention, the movable housing, the movable refractory plate and the stationary refractory plate preferably have substantially elliptical shapes, with the long dimension or diameter of each element extending in the direction of swivelling movement. By this arrangement, expansion of the sliding or sealing surfaces of the two plates can be kept relatively small, and an appropriate configuration of the discharge openings through the plates can be achieved. Preferably, the movable refractory plate has therethrough two discharge openings spaced from each other and centered on a circular arc centered at the axis of the swivel pin, and the stationary refractory plate has therethrough a spare or second discharge opening spaced from the first-mentioned discharge opening thereof along a straight line intersecting the axes of the first-mentioned discharge opening and the swivel pin. By this arrangement, it first is possible to employ one discharge opening of each of the refractory plates. When these discharge openings become eroded, then it is possible to switch the plates within the respective housings to employ the other discharge openings for operation of the unit.

In accordance with a further feature of the present invention, the stationary housing and movable housing each have a generally crescent-shaped clamping jaw having a first end pivoted to the respective housing and a second end adjustably movable toward the respective refractory plate by means of a control spindle. This makes it possible to remove and replace the refractory plates with respect to the housings by a simple operation. Advantageously, the movable housing has at one end thereof a connecting member for attachment to the power transmitter or motive device which is employed to achieve swivelling movement. This arrangement locates the movement device in the immediate vicinity of the movable refractory plate to ensure accurate swivelling movements.

BRIEF DESCRIPTION OF THE DRAWINGS

Other objects, features and advantages of the present invention will be apparent from the following detailed description, with reference to the accompanying drawings, wherein.

DETAILED DESCRIPTION OF THE INVENTION

Figure 1:
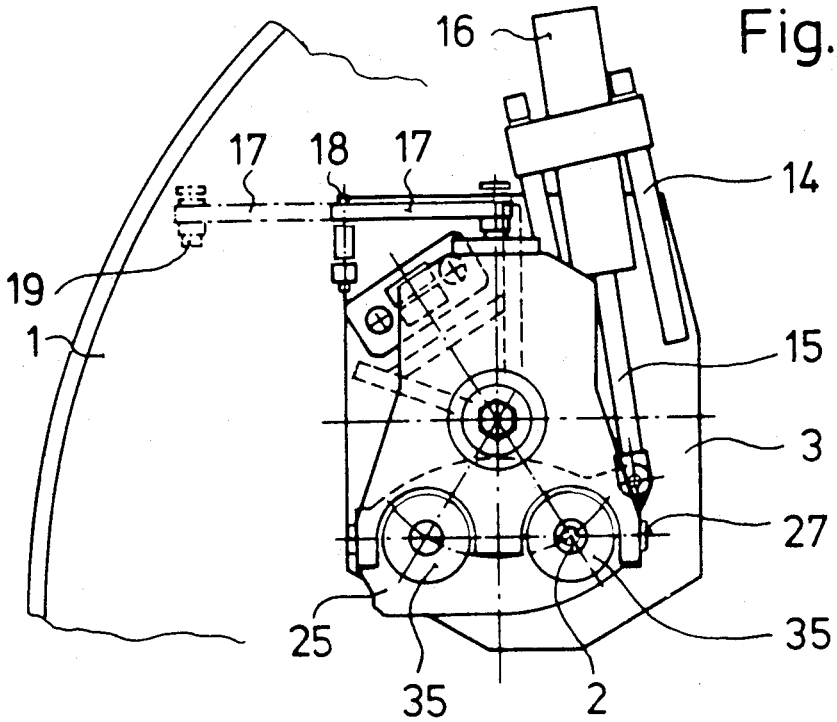
FIG. 1 is a partial bottom plan view of the bottom of a metallurgical vessel equipped with a swivelling, sliding closure unit according to the present invention and shown in the operative position thereof.
Figure 5:
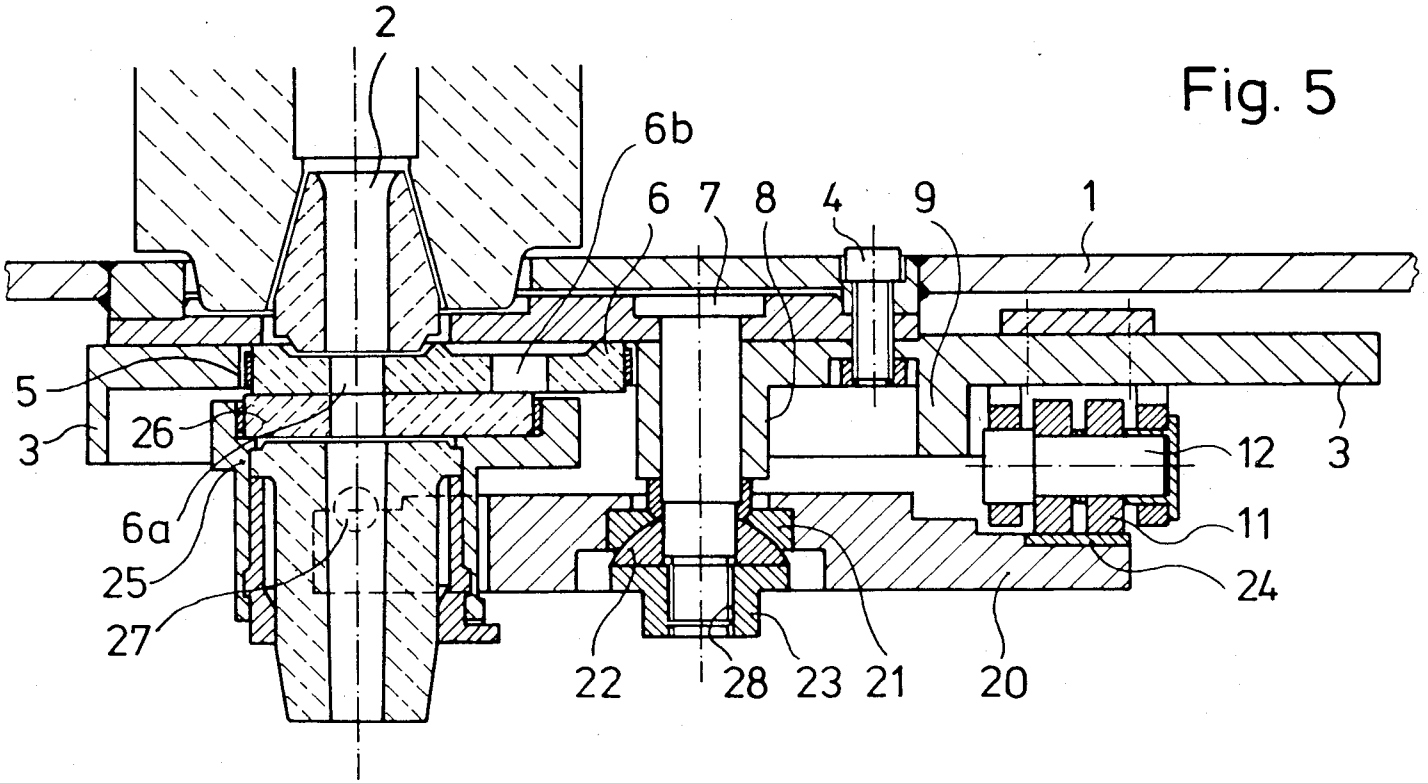
FIG. 5 is a longitudinal, cross-sectional view through the sliding closure unit of the present invention.

FIGS. 1 and 5 partially illustrate a metallurgical vessel, for example, a casting ladle, having a metal jacket 1 having extending therethrough a pouring brick having therethrough an outlet orifice or opening 2. The sliding closure unit of the present invention includes a stationary housing 3 fixed to the bottom of the metallurgical vessel, for example, by means of bolts 4, housing 3 having therein a recess 5 receiving and mounting a stationary refractory plate 6 having therethrough a discharge opening **6*a* aligned with outlet opening 2. A swivel pin 7 is fixed to and extends downwardly from housing 3, for example, through a spindle bearing 8, housing 3 further being provided with rigid bracings 9. Housing 3 further has a bearing block 10 supporting an axle 12 of a rolling element 11, the axis of axle 12 extending in a straight line passing through and intersecting the axis of swivel pin 7 and the center axis of aligned openings 2, 6*a*. Housing 3 further carries a support 14 for the flexible mounting of a power transmitter or movement device 16 having a piston 15**.

A swivel lever 20 has first and second opposite ends and is mounted about swivel pin 7 at a portion thereof between the first and second ends, thereby forming a two-arm lever. A movable refractory plate 26 has therethrough a discharge opening **26*b* and is mounted in a movable frame or housing 25 which is pivoted to the first end of swivel lever 20 by means of an axle 27 which extends transverse to the longitudinal direction of swivel lever 20. Thus, swivelling movement of housing 25 and refractory plate 26 with respect to lever 20 are provided by means of axle 27, thereby allowing the sliding surface of refractory plate 26 to adapt to the complementary sliding surface of stationary refractory plate 6**.

The second end of swivel lever 20 has formed thereat a raceway 24 abutting rolling element 11 during swivelling movement of lever 20 about pin 7. The connection of lever 20 to pin 7 is by means of a gimbal bearing arrangement including a first annular member 21 which is mounted within lever 20 and which defines a partial spherical concave recess, and a second annular member 22 defining a complementary partial spherical convex surface. Member 22 is mounted on a clamp 23 which has internal threads which are threaded onto external threads at the lower end of pin 7. Member 21 is positioned to be coaxial with and spaced outwardly of pin 7, and complementary surfaces of members 21 and 22 abut to define a universal ball-race bearing enabling universal swivelling movement of lever 20 with respect to pin 7. Clamp 23 further urges the lever 20 upwardly and thereby urges movable refractory plate 26 toward stationary refractory plate 6 and also urges raceway 24 toward rolling element 11. Thereby, lever 20 may be locked axially in position with respect to pin 7 but with allowance for flexible motion. Thus, there is achieved an arrangement of a gimbal, universal joint mounting of lever 20 about pin 7, as well as a pivotal mounting of plate 26 with respect to lever 20. This ensures that the complementary sliding surfaces of refractory plates 6,26 are in tight fitting engagement with each other during all relative positions therebetween.

Operation of movement device 16 to extend or retract piston 15, which is connected to the swivel lever in a manner to be discussed in more detail below, results in swivelling of lever 20 about pin 7 and thereby sliding movement of movable refractory plate 26 with respect to stationary refractory plate 6 between a first position, shown in FIG. 3, whereat discharge opening 26*b* of movable refractory plate 26 is aligned with discharge opening 6*a* of stationary refractory plate 6, and thereby with outlet opening 2, a second position (shown in FIG. 4) whereat discharge openings 26*b*, 6*a* are out of alignment, and a replacement third position illustrated in FIG. 1.

Figure 2:
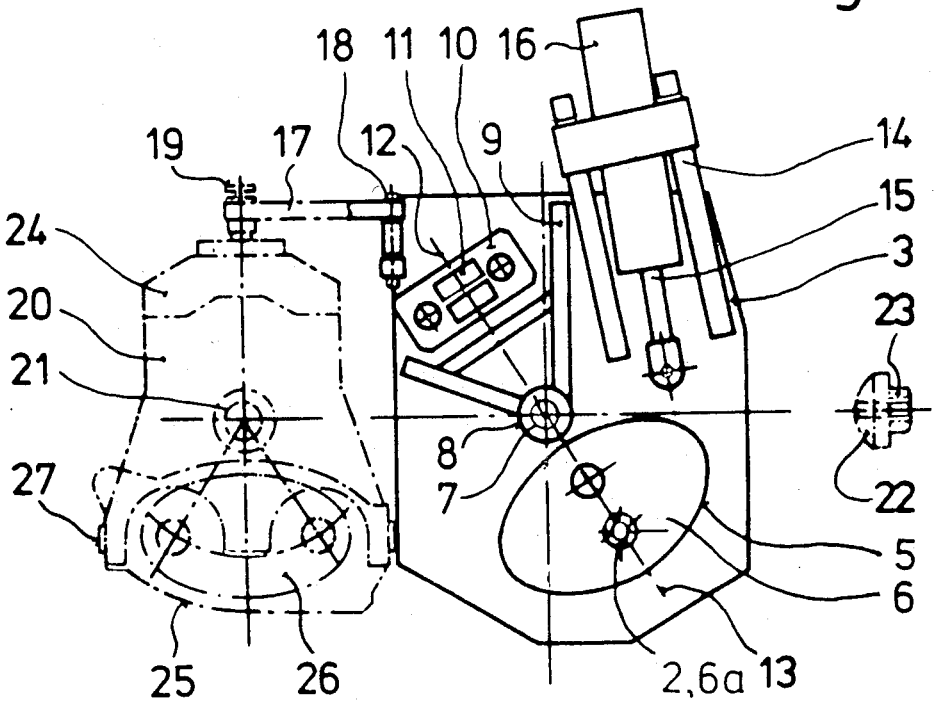
FIG. 2 is a view similar to FIG. 1, but illustrating the sliding closure unit in the opened, replacement position.

In accordance with a further feature of the present invention, when the lever 20 is in the replacement third position illustrated in FIG. 1, lever 20 may be unclamped from pin 7 and moved to an opened position, shown by dashed lines in FIG. 2, to enable replacement of refractory plates 6,26. Thus, a bracket 17 has a first end hinged to a longitudinal edge of housing 3 by means of a first pin 18 and a second end which is connectable to an end of swivel lever 20 by means of a second pin 19 extending parallel to first pin 18, when the movement device 16 is operated to position lever 20 in the replacement third position shown in FIG. 1.

Figure 7:
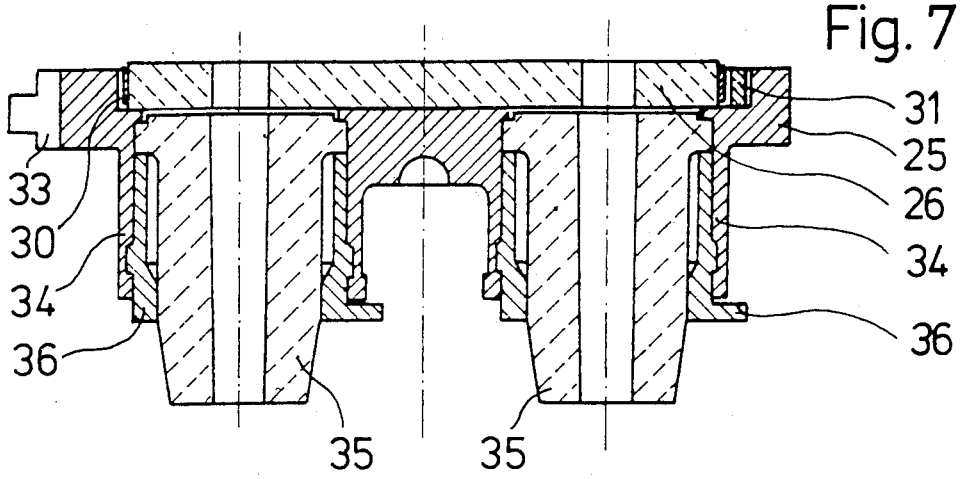
FIG. 7 is a cross-sectional view taken along the line VII—VII of FIG. 6.
Figure 6:
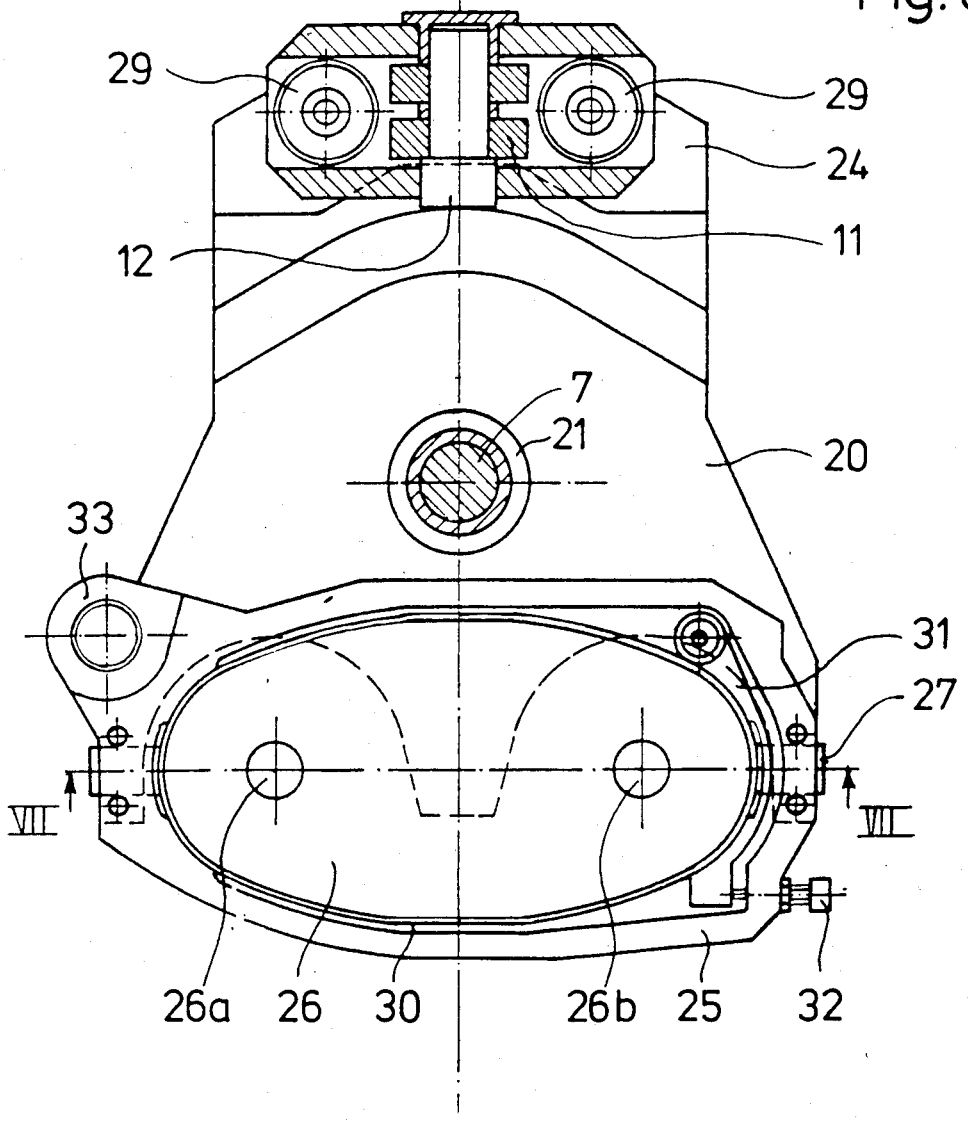
FIG. 6 is a top plan view of a portion of the sliding closure unit.

As will be apparent particularly from FIGS. 5–7, the flexible mounting of swivel lever 20 on swivel pin 7 by means of the gimbal bearing arrangement 21,22 and clamp 23, as well as the guidance of raceway 24 along stationary rolling element 11 to a large extent satisfy the operating conditions prevailing in the metallurgical vessel. This arrangement results in a stable system adapted for mounting and dismounting with a few manipulations and which enables adjustment of an optimum elastic surface pressure between the complementary sliding surfaces of refractory plates 6,26, in a functional interaction between joint axle 27 and the gimbal bearing arrangement. The elasticity may be provided in the swivel lever 20 itself, or can be generated by spring mechanisms 29 acting on axle 12 and rolling element 11 in a direction toward raceway 24 with a progressively increasing spring force. To permit better control of clamp 23 during the clamping of swivel lever 20, annular member 22 can be arranged by means of roller contact on clamp 23.

The refractory plates 6,26 preferably are elliptically shaped and are held together by respective peripheral rings 30. Movable refractory plate 26 has therethrough two discharge openings 26*a*,26*b* spaced from each other and centered on a circular arc 37 centered at the axis of swivel pin 7. Also, stationary refractory plate 6 has therethrough a second discharge opening (see FIG. 2) spaced from discharge opening 6*a* along a straight line 13 intersecting the axes of discharge opening 6*a* and swivel pin 7. Thus, it is possible for plates 6,26 to each be rotated by 180° in the swivel plane, thereby exchanging the positions of the two discharge openings of the respective plates. Thus, when the first, operative discharge openings become worn or eroded, such switching of the plates aligns the respective second discharge openings in the operative positions. This prolongs the service life of the refractory plates. Furthermore, the discharge opening through the movable refractory plate which is not employed for the molten metal discharge position shown in FIG. 3, can be aligned with the discharge opening in the stationary refractory plate, i.e., in the position of FIG. 1, for the purpose of introducing a metallurgical treatment material into the metallurgical vessel or for introducing a lance to melt metal which may become frozen in outlet opening 2.

As shown particularly in FIG. 6, movable housing 25 has a generally elongated, elliptical configuration. Each housing 3,25 can be provided with a generally crescent-shaped clamping jaw 31 having a first end pivoted to the respective housing and a second end adjustably movable toward the respective refractory plate by means of a control spindle 32.

Furthermore, as shown particularly in FIG. 6, movable housing 25 may have at one end thereof a connecting member 33 for attachment to the outer end of piston 15 of movement device 16.

As further shown particularly in FIGS. 5 and 7, frame 25 may be provided with bayonet-type sockets 34 for connecting replaceable refractory spouts 35 to the movable plate 26 by means of replaceable sleeves 36.

The above structure of the present invention operates in the following manner for exchanging the refractory plates 6,26. Thus, replaceable spouts 35 first are removed. Piston 15 then is extended to move lever 20 to the position shown in FIG. 1, and piston 15 is disconnected from connecting member 33. Pin 19 of bracket 17 then is connected to the adjacent end of lever 20, thereby supporting lever 20. Clamp 23 then is removed from swivel pin 7. The swivel lever 20 and the movable housing 25 and movable refractory plate 26 then are swung around the axis of pin 18 to the dashed line position shown in FIG. 2. At this position, refractory plates 6,26 may be replaced or repositioned. The lever 20 then again is pivoted about axis 18 to the position shown in FIG. 1, and clamp 23 then is engaged on pin 7 to support lever 20. Pin 19 then is removed from lever 20, and bracket 17 is swung about pin 18 to the dashed line position shown in FIG. 1. Piston 15 again is connected to member 33, and replaceable spouts 35 again are mounted. The unit then again is in condition for further operation.

Figure 3:
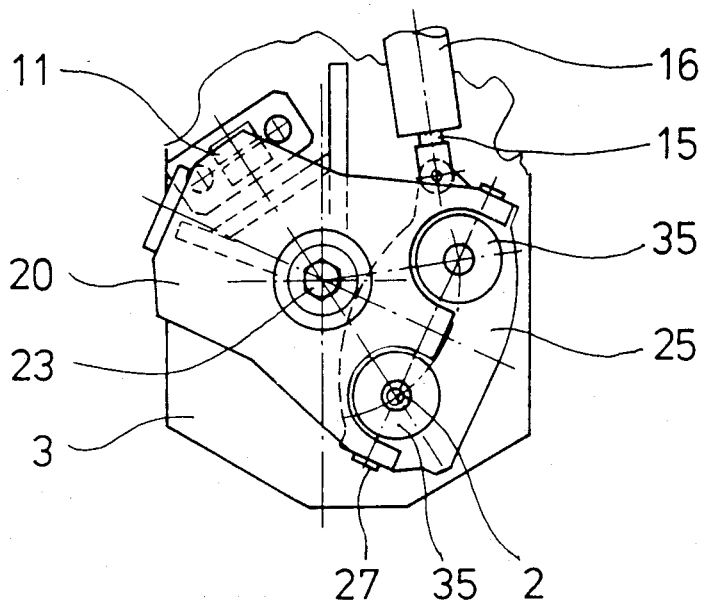
FIGS. 3 and 4 are partial views similar to FIG. 1 but illustrating the sliding closure unit in the discharge position and the closed position, respectively.
Figure 4:
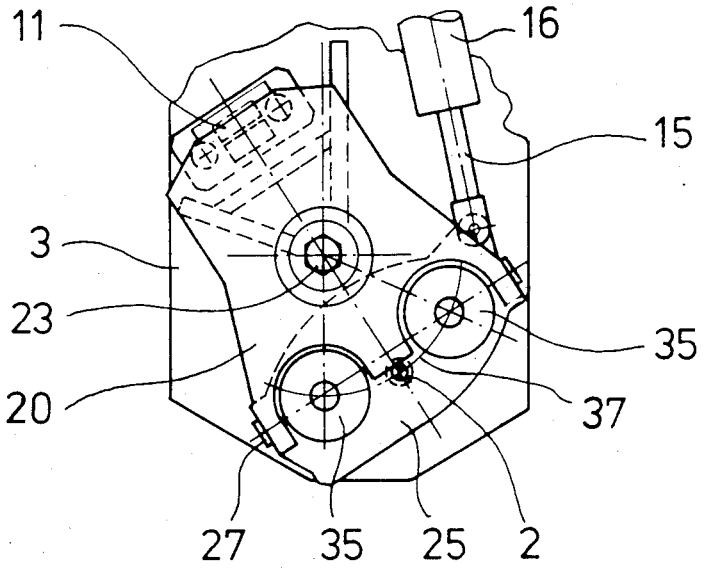

The actual control of the discharge of molten metal is achieved between the two positions shown in FIGS. 3 and 4, whereas, as discussed above, the position of FIG. 1 is employed, other than for the above discussed refractory plate exchangement operation, only when it is necessary to introduce a material into the metallurgical vessel or to melt or burn out metal frozen in outlet opening 2.

Although the present invention has been described and illustrated with respect to preferred features thereof, it is to be understood that various modifications and changes may be made to the specifically described and illustrated features without departing from the scope of the present invention.

What is claimed is:

1. A swivelling sliding closure unit for controlling the discharge of molten metal from a metallurgical vessel, said unit comprising:

a stationary refractory plate having a discharge opening;

a stationary housing to be fixed to the bottom of a metallurgical vessel and supporting said stationary refractory plate in a position with said discharge opening thereof in alignment with an outlet opening of the metallurgical vessel;

a swivel pin fixed to said stationary housing;

a swivel lever having first and second ends;

gimbal bearing means supporting said swivel lever at a portion thereof between said first and second ends to enable said swivel lever to universally rotate about said swivel pin;

a movable refractory plate having therethrough a discharge opening;

means at said first end of said swivel lever for supporting said movable refractory plate in position against said stationary refractory plate and for enabling said movable refractory plate to pivot with respect to said swivel lever about a pivot axis;

means for rotating said swivel lever about said swivel pin and thereby for sliding said movable refractory plate with respect to said stationary refractory plate between a first position whereat said discharge opening of said movable refractory plate is aligned with said discharge opening of said stationary refractory plate, a second position whereat said discharge openings are out of alignment, and a replacement third position;

a rolling element mounted on said stationary housing;

a raceway formed on said second end of said swivel lever and abutting said rolling element during rotation of said swivel lever about said swivel pin;

clamping means for removably mounting said swivel lever on said swivel pin and for urging said movable refractory plate toward said stationary refractory plate and said raceway toward said rolling element; and bracket means, hingedly connected to said stationary housing and connectable to said swivel lever when said swivel lever is in said replacement third position, for, upon removal of said clamping means, swinging said swivel lever and said movable refractory plate away from said swivel pin and said stationary refractory plate to an open position enabling replacement of said refractory plates.

2. A unit as claimed in claim 1, wherein said gimbal bearing means comprises a first annular member defining a partial spherical concave recess and mounted within said swivel lever, and a second annular member defining a complementary partial spherical convex surface and mounted on said clamping means.

3. A unit as claimed in claim 2, wherein said clamping means has internal threads threaded onto external threads of said swivel pin, thereby urging said convex surface into engagement with said concave recess and enabling universal swivelling movement of said swivel lever about said swivel pin.

4. A unit as claimed in claim 1 wherein said rolling element is rotatable about an axis extending in a straight line intersecting the axis of said swivel pin and the center axis of said discharge opening of said stationary refractory plate.

5. A unit as claimed in claim 4, further comprising an axle supporting said rolling element, and spring means urging said axle and rolling element toward said raceway with a progressively increasing spring force.

6. A unit as claimed in claim 1, wherein said bracket means has a first end hinged to a longitudinal edge of said stationary housing by means of a first pin and a second end connectable to an end of said swivel lever by means of a second pin extending parallel to said first pin.

7. A unit as claimed in claim 1, wherein said supporting means at said first end of said swivel lever comprises a movable housing mounting therein said movable refractory plate and pivotally mounted on said first end of said swivel lever by means of an axle extending transverse to the longitudinal direction of said swivel lever.

8. A unit as claimed in claim 7, wherein said movable housing, said movable refractory plate and said stationary refractory plate each have a substantially elliptical shape.

9. A unit as claimed in claim 8, wherein said movable refractory plate has therethrough two 2discharge openings spaced from each other and centered on a circular arc centered at the axis of said swivel pin, and said stationary refractory plate has therethrough a second discharge opening spaced from the firs-tmentioned discharge opening thereof along a straight line intersecting the axes of said first-mentioned discharge opening and said swivel pin.

10. A unit as claimed in claim 8 wherein said stationary housing and said movable housing each have a generally crescent-shaped clamping jaw having a first end pivoted to the respective said housing and a second end adjustably movable toward the respective said refractory plate by means of a control spindle.

11. A unit as claimed in claim 8, wherein said movable housing has at one end thereof a connecting member for attachment to said rotating means.

* * * * *